US008794102B2

(12) United States Patent
Heitkamp

(10) Patent No.: US 8,794,102 B2
(45) Date of Patent: Aug. 5, 2014

(54) ACCELERATOR PEDAL ASSEMBLY FOR VEHICLE

(75) Inventor: Eric Heitkamp, Columbus, OH (US)

(73) Assignee: Honda Motor Co., Ltd., Tokyo (JP)

( * ) Notice: Subject to any disclaimer, the term of this patent is extended or adjusted under 35 U.S.C. 154(b) by 688 days.

(21) Appl. No.: 12/777,821

(22) Filed: May 11, 2010

(65) Prior Publication Data

US 2011/0277584 A1 Nov. 17, 2011

(51) Int. Cl.
*G05G 1/44* (2008.04)

(52) U.S. Cl.
CPC ..... *G05G 1/44* (2013.01)
USPC ..... 74/513; 74/512; 74/560; 180/90.6; 180/271

(58) Field of Classification Search
USPC ..... 74/512–514, 560; 180/90.6, 271
IPC ..... B60T 7/06
See application file for complete search history.

(56) References Cited

U.S. PATENT DOCUMENTS

| | | | | |
|---|---|---|---|---|
| 1,277,207 | A | 8/1918 | Fischer | |
| 3,065,649 | A | 11/1962 | Stringer | |
| 3,108,651 | A * | 10/1963 | Miller | 180/90.6 |
| 5,997,438 | A * | 12/1999 | Murakowski | 477/213 |
| 6,182,526 | B1 * | 2/2001 | Brooks | 74/512 |
| 6,336,376 | B1 * | 1/2002 | Lee | 74/512 |
| 6,752,038 | B2 * | 6/2004 | Cordero | 74/512 |
| 7,090,046 | B2 * | 8/2006 | Nebuya et al. | 180/274 |
| 7,954,589 | B2 * | 6/2011 | Sand et al. | 180/274 |
| 2001/0027889 | A1 * | 10/2001 | Thistleton | 180/271 |
| 2003/0019320 | A1 * | 1/2003 | Thistleton et al. | 74/560 |
| 2003/0037632 | A1 | 2/2003 | Cho | |
| 2003/0047022 | A1 * | 3/2003 | Gohbrandt et al. | 74/512 |
| 2004/0211286 | A1 * | 10/2004 | Schwerdt et al. | 74/512 |
| 2007/0289403 | A1 | 12/2007 | Yoshihara et al. | |
| 2009/0069155 | A1 | 3/2009 | Dickinson | |
| 2010/0140008 | A1 * | 6/2010 | Kim et al. | 180/271 |
| 2011/0290068 | A1 * | 12/2011 | Uenver et al. | 74/560 |

FOREIGN PATENT DOCUMENTS

| | | | | |
|---|---|---|---|---|
| GB | 2 316 467 A | * | 2/1998 | G05G 1/14 |
| JP | 2000-43689 | * | 2/2000 | B60T 7/06 |
| JP | 2001001827 | | 1/2001 | |
| JP | 2001-117656 | * | 4/2001 | B60T 7/06 |

OTHER PUBLICATIONS

English Abstract of JP 2001-117656 A, Hiroshi, Apr. 27, 2001.*
Machine Translation of JP 2001-117656, Hiroshi, Apr. 27, 2001.*
English Abstract of JP 2000-43689; Tsukio; Feb. 15, 2000.*

* cited by examiner

*Primary Examiner* — Vinh Luong
(74) *Attorney, Agent, or Firm* — Rankin, Hill & Clark LLP

(57) ABSTRACT

An accelerator pedal assembly for a vehicle includes a pedal arm having a first end portion pivotally secured to the vehicle, a pedal pivotally mounted to a second end portion of the pedal arm, and a guard plate secured to the pedal arm forwardly of the pedal.

12 Claims, 8 Drawing Sheets

ACCELERATOR PEDAL ASSEMBLY FOR VEHICLE

BACKGROUND

The present disclosure generally relates to accelerator pedal assemblies for vehicles.

As is well known, accelerator pedal assemblies include a pedal which a driver of a vehicle operates with his or her foot. Movement of the pedal adjusts a throttle of the vehicle. For example, when the driver depresses the pedal, the throttle is opened a corresponding amount to increase airflow into the combustion chambers of the vehicle's engine and thereby cause acceleration of the vehicle. Typically, the accelerator pedal assembly includes a pedal rotatably mounted along the driver's side floor (e.g., to the right of a brake pedal in a left-hand drive vehicle). The accelerator pedal is movable between a starting position in which no force is applied and an end position in which the pedal is fully depressed.

Early accelerator pedal assemblies included a mechanical linkage between a pedal and the vehicle's throttle valve. In this arrangement, movement of the pedal was mechanically communicated directly to the throttle valve. More recent systems employ drive-by-wire technology in which the mechanical link between the accelerator pedal and the throttle is no longer required. Instead, an electrical connection or communication is provided between the pedal and the throttle. Movement of a drive-by-wire accelerator pedal is communicated to an electronic control unit (ECU), which sends a command signal to a throttle controller for opening the throttle valve an amount corresponding to the position of the accelerator pedal, though additional vehicle conditions can be used by the ECU in determining the precise amount in which to open the throttle valve.

A known accelerator pedal assembly (FIGS. 1-2) includes a pedal arm having a first end portion pivotally secured to the vehicle and a pedal pivotally mounted to a second end portion of the pedal arm. An operator's foot is applied to the pedal to control pivotal movement of the arm and thereby provide feedback from the driver as to the driver's desired amount of acceleration. In the known pedal assembly, the driver's foot can slide off the accelerator pedal during a collision event (e.g., a front end collision). In particular, the driver's foot can slide forward off the pedal and come into contact with the pedal arm. The foot is not stabilized such that the contact with the pedal arm can cause the foot to roll off of the pedal. This can lead to injuries to the lower leg (e.g., tibia).

SUMMARY

In accordance with one aspect, an improved accelerator pedal assembly is provided for a vehicle. More particularly, in accordance with this aspect, the pedal assembly includes a pedal arm having a first end portion pivotally secured to the vehicle. A pedal is pivotally mounted to a second end portion of the pedal arm. A guard plate is secured to the pedal arm forwardly of the pedal.

In accordance with another aspect, an accelerator pedal assembly is provided for a vehicle. More particularly, in accordance with this aspect, the pedal assembly includes a mounting support mounted on the vehicle above a floor of the vehicle. A pedal arm extends from the mounting support. A pedal is connected to the pedal arm at a location spaced apart from the mounting support. A guard plate is secured to the pedal arm forwardly as the pedal to limit foot movement during a crash event.

In accordance with still another aspect, a vehicle pedal assembly is provided. More particularly, in accordance with this aspect, the pedal assembly includes a pedal arm extending from a pivot connection. A guard plate is mounted to the pedal arm. A pedal has an upper end pivotally connected to the pedal arm at a location spaced apart from the guard plate.

In accordance with still yet another aspect, a vehicle accelerator pedal assembly is provided. More particularly, in accordance with this aspect, the pedal assembly includes a guard plate secured to a pedal arm (e.g., by welding). The guard plate can be secured to the pedal arm in the region of the pedal arm that would otherwise be contacted by a driver's foot during a collision event (e.g., forwardly of the pedal). Such contact between the driver's foot and the surface of the guard plate (i.e., instead of with the pedal arm) can stabilize the foot on the pedal such that the foot tends to remain in contact with the pedal face instead of rolling off the pedal and resulting in an injury to the driver.

DETAILED DESCRIPTION

Figure 1:
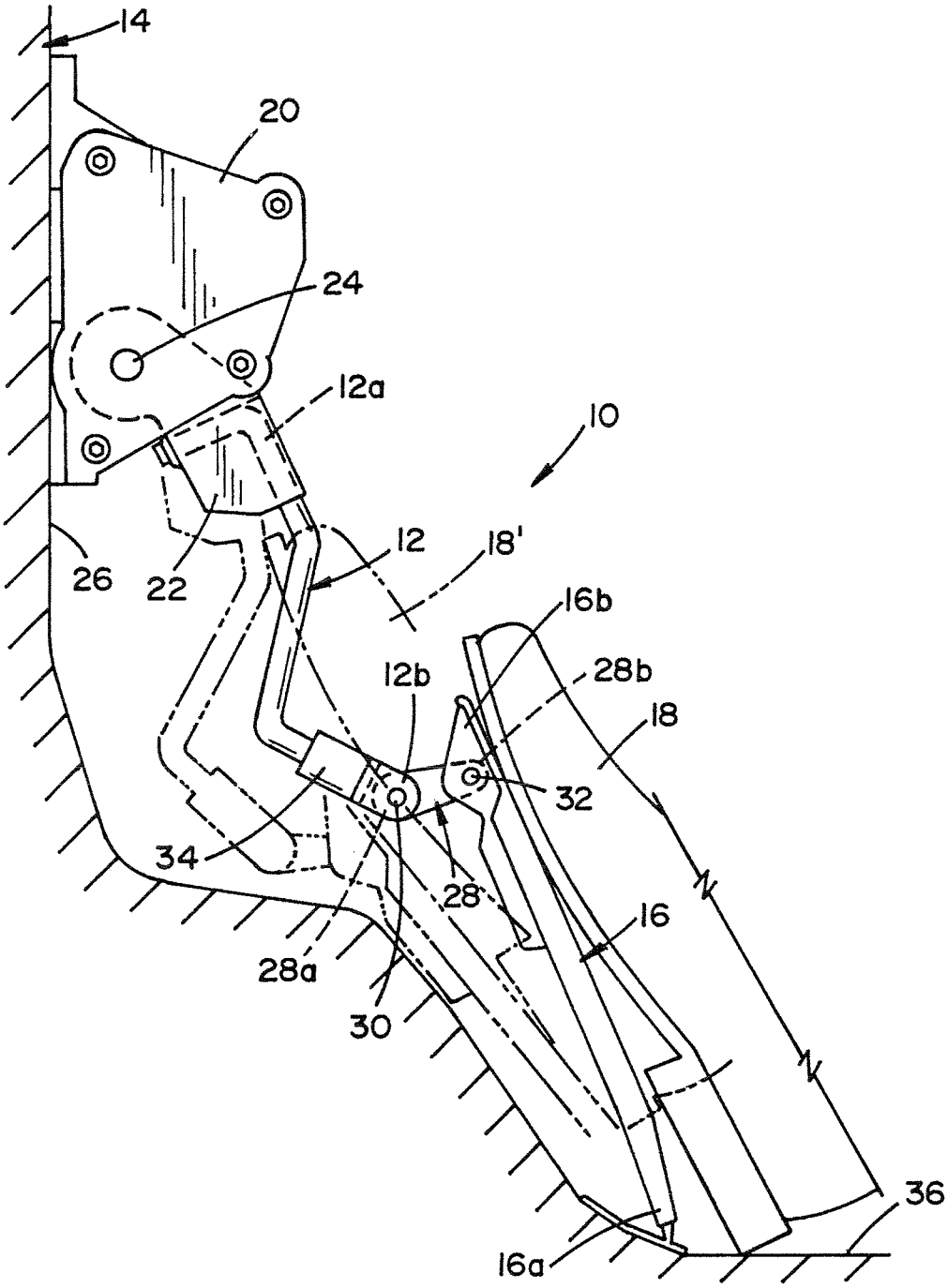
FIG. 1 (PRIOR ART)
FIG. 1 is a schematic side view of accelerator pedal assembly for a vehicle according to the prior art.
Figure 2:
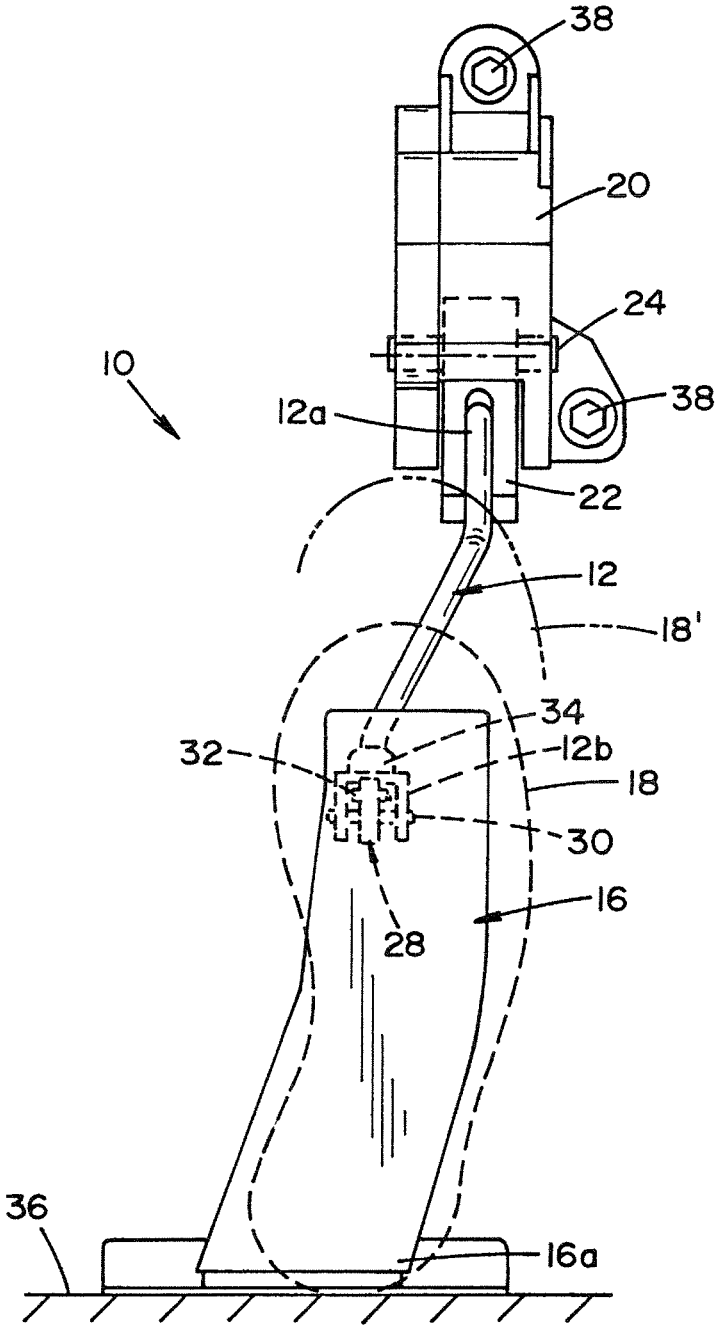
FIG. 2 (PRIOR ART)
FIG. 2 is a front elevational view of the accelerator pedal assembly of FIG. 1.

Referring now to the drawings wherein the showings are for purposes of illustrating one or more exemplary embodiments and not for limiting same, an accelerator pedal assembly for a vehicle is depicted in FIGS. 1 and 2 and generally indicated by reference numeral 10. The illustrated pedal assembly 10 includes a pedal arm 12 having a first end portion 12*a* pivotally secured to a vehicle 14. The pedal assembly 10 further includes a pedal or pedal pad 16 mounted to a second end portion 12*b* of the pedal arm 12. As is known and understood by those skilled in the art, depression of the pedal 16 by a driver's foot 18 results in movement of the pedal arm 12 relative to the vehicle 14 to indicate a driver's desired amount of acceleration for the vehicle 14. For example, when no force is applied against the pedal 16 by driver's foot 18, the pedal is in its fully raised position (the position illustrated in FIG. 1) and when force is applied to the pedal 16 by the foot 18 the pedal is moveable from the illustrated position to the fully depressed position (illustrated in phantom lines in FIG. 1), or any position therebetween.

As shown, the pedal arm 12 can be pivotally connected to the vehicle 14. In particular, in the illustrated embodiment of FIGS. 1 and 2, the first end portion 12*a* of the pedal arm 12 is pivotally connected to a mounting support 20. Specifically, the first end portion 12*a* of the pedal arm 12 is fixed to a moveable member 22, which is itself pivotally connected to the mounting support 20 by a pivot pin 24. The mounting support 20 can include a sensor module that detects or senses movement of the pedal 16 by measuring angular movement of the pedal arm 12 relative to the mounting support 20, though this is not required. The mounting support 20 can be secured to a vehicle body portion 26 (e.g., a firewall) of the vehicle 14 via bolts 38 (FIG. 2).

The pedal 16 can also be pivotally connected to the pedal arm 12. More specifically, as shown in the illustrated embodiment, a link 28 can pivotally connect the pedal 16 to the pedal arm 12. The link 28 can have a first end 28*a* pivotally connected to the pedal arm 12 via a pivot pin 30, and particularly to the second end portion 12*b* of the pedal arm 12, and a second end 28*b* pivotally connected to the pedal 16 via a pivot pin 32, and particularly to an upper edge or end 16*b* of the pedal 16. As shown, the second end portion 12*b* of the pedal arm 12 can include a sleeve member 34 in which the pedal arm 12 is received, the sleeve member 34 being pivotally connected to the link 28 by the pivot pin 30. Though not illustrated in FIGS. 1 and 2, a coil spring can be disposed about pivot pin 32 for urging the pedal 16 toward its non-depressed position. Additionally, a lower edge or end 16*a* of the pedal 16 can be pivotally connected to a floor 36 of the vehicle (or to a location adjacent the floor 36).

One drawback of the accelerator pedal assembly 10 of FIGS. 1 and 2 is that the foot 18 can slide forwardly off the pedal 16 into the pedal arm 12 during a crash or collision event (e.g., a front end collision) as indicated by the foot 18' shown in phantom. In this situation, the pedal arm 12 can cause the foot 18' to roll or rotate off the pedal 16. Thus, the accelerator pedal assembly 10 of FIGS. 1 and 2 does not stabilize the driver's foot during a crash event and instead can allow the foot to roll off the pedal 16.

Figure 3:
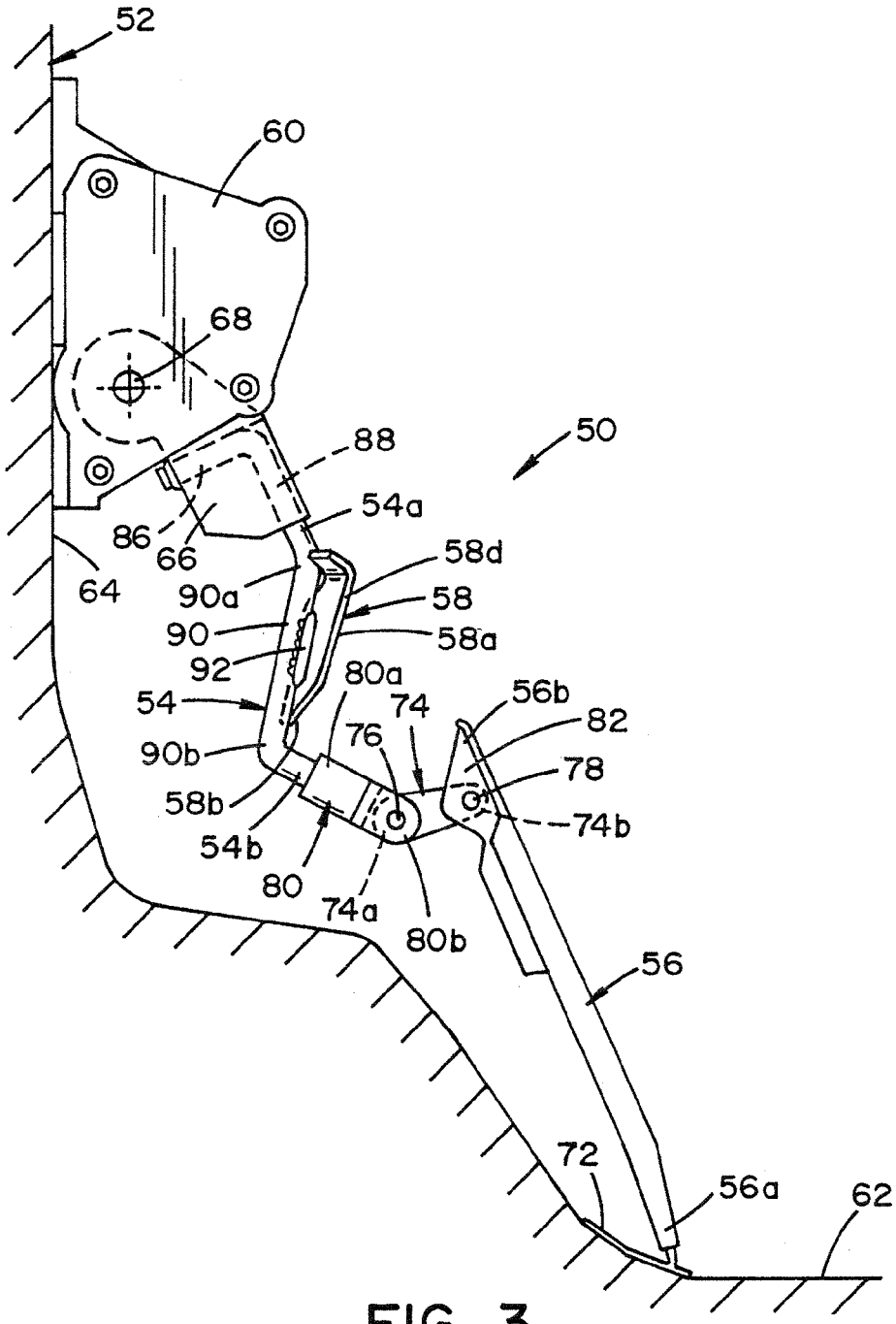
FIG. 3 is a schematic elevational view of an improved accelerator pedal assembly for a vehicle according to an exemplary embodiment of the invention.
Figure 4:
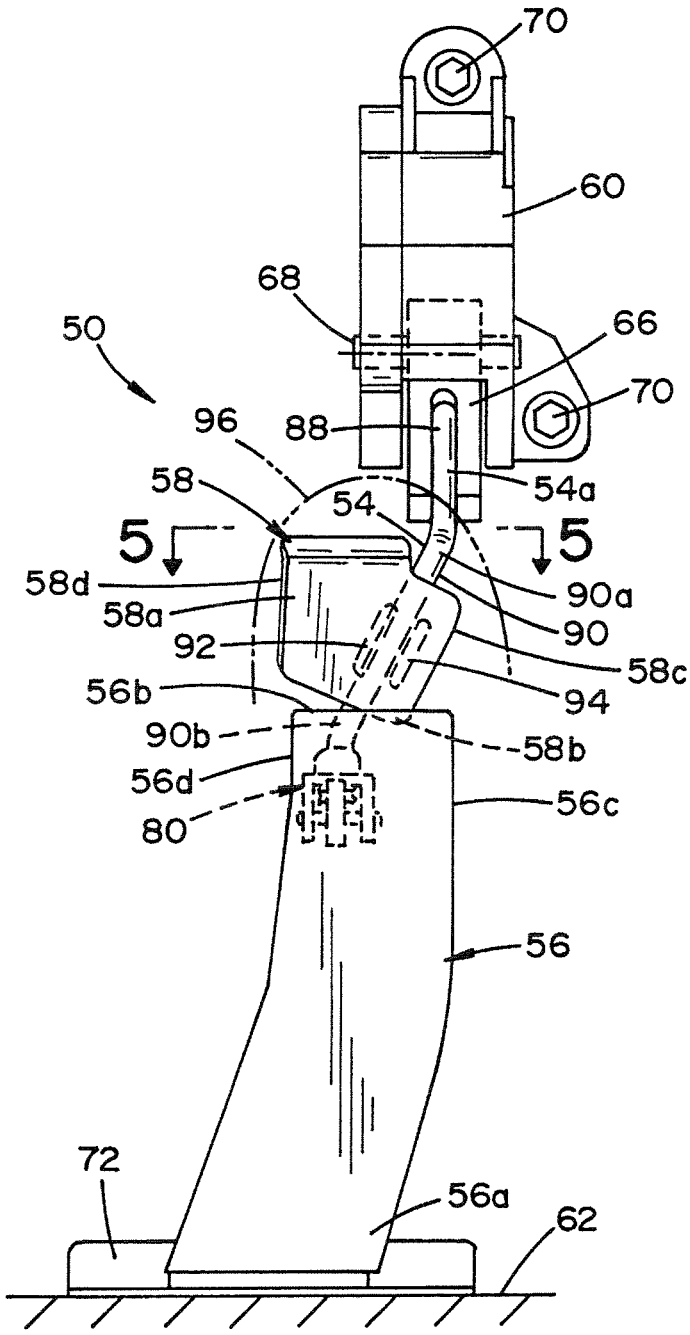
FIG. 4 is a front elevational view of the accelerator pedal assembly of FIG. 3.

With reference to FIGS. 3 and 4, an improved accelerator pedal assembly 50 is illustrated for a vehicle 52. The pedal assembly 50 includes a pedal arm 54 having a first end portion 54*a* pivotally secured to the vehicle 52. A pedal or pedal pad 56 is mounted to a second end portion 54*b* of the pedal arm 54. In addition, as will be described in more detail below, the pedal assembly 50 includes a guard plate 58 secured to the pedal arm 54 forwardly (i.e., relative to the vehicle 52) of the pedal 56 to limit foot movement during a crash event.

The pedal assembly 50 can additionally include a mounting support 60 mounted on the vehicle 52 above a floor 62 of the vehicle. In the illustrated embodiment, the mounting support 60 is mounted to a vertical body portion 64 of the vehicle 52, which could be a firewall, for example. As shown, the pedal arm 54 extends from the mounting support 60 and the pedal 56 is connected to the pedal arm 54 at a location spaced apart from the mounting support 60. In particular, the mounting support 60 pivotally connects the pedal arm 54 to the body portion 64 of the vehicle 52.

In the illustrated embodiment, this pivotal relationship is accomplished by the first end portion 54*a* of the pedal arm 54 being fixedly mounted to a moveable member 66, which is itself pivotally mounted to the mounting support 60 via a pivot pin 68. The mounting support 60 can be fixedly secured to the vertical body portion 64 through any known mounting means or types, such as the illustrated bolts 70 (FIG. 4) for example. In one embodiment, the mounting support 60 includes a sensor module employing drive-by-wire technology to sense, via angular displacement of the pedal arm 54 when moved through depression of the pedal 56 by a driver's foot, an amount of acceleration desired by the driver. Such angular displacement of the pedal arm 54 is measured and communicated as a signal to an electronic control unit (not shown), which can then use such information for determining a degree of opening for a throttle valve of the vehicle 52.

In the illustrated embodiment, a lower edge or end 56*a* of the pedal 56 is pivotally mounted to the floor 62 through a mounting plate 72 and an upper edge or end 56*b* of the pedal 56 is pivotally connected to a distal end or second end portion 54*b* of the pedal arm 54. In particular, a link 74 can connect the pedal 56 and the pedal arm 54. As shown, the link 74 can have a first end 74*a* pivotally connected to the pedal arm 54 and a second end 74*b* pivotally connected to the pedal 56. More specifically, the link 74 is disposed between the distal end 54*b* of the pedal arm 54 and the upper edge or end 56*b* of the pedal 56. The link 74 has its first end 74*a* pivotally connected to the distal end 54*b* of the pedal arm 54 via a pivot pin 76 and the second end 74*b* pivotally connected to the upper edge or end 56*b* of the pedal via a pivot pin 78.

Figure 5:
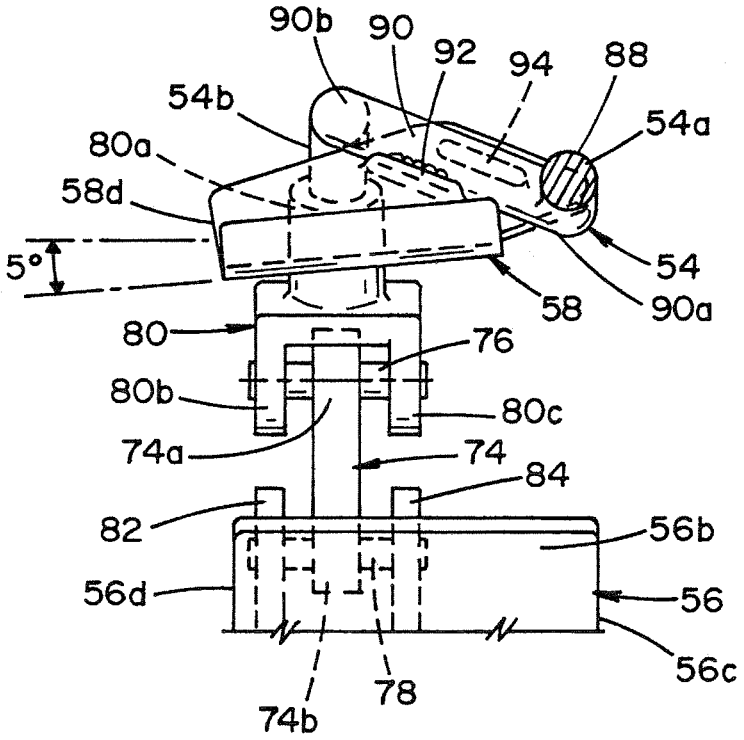
FIG. 5 is a partial cross-sectional view of the accelerator pedal assembly taken along the line 5-5 of FIG. 4.

With additional reference to FIG. 5, the distal end portion 54*b* of the pedal arm 54 can include a sleeve member 80 fixedly secured thereon. Sleeve member 80 can include a sleeve portion 80*a* that receives the distal end portion 54*b* of the pedal arm 54 therein. Sleeve member 80 can additionally include spaced apart arms 80*b*,80*c* between which the first end 74*a* of the link 74 is pivotally secured by the pivot pin 76. Similarly, the pedal 56 can include flanged projections 82,84 between which the second end 74*b* of the link 74 is pivotally connected to the pedal 56 by the pivot pin 78.

In the illustrated embodiment, the pedal arm 54 includes the first end portion 54*a*, which extends from the pivot location (i.e., pivot pin 68) at which the pedal arm 54 is pivotally secured to the vehicle 52. In particular, the first end portion 54*a* of the illustrated embodiment includes segments 86, 88 oriented approximately normal or perpendicular relative to one another. Pedal arm 54 also includes a middle portion 90 extending downward from the first end portion 54*a*, and particularly segment 88 thereof. The second end portion 54*b* extends from the middle portion 90 toward the pedal 56. As is shown, the guard plate 58 is fixedly secured to the middle portion 90. In particular, the middle portion 90 of the pedal arm 54 extends from the first end portion 54*a* downwardly and transversely across the vehicle 52. As best shown in FIG. 4, a first end 90*a* of the middle portion 90 is generally laterally aligned with an adjacent first lateral edge 56*c* of the pedal 56 and a second end 90*b* of the middle portion 90 is generally laterally aligned with an adjacent a second lateral edge 56*d* of the pedal 56.

The guard plate 58 can be secured to the pedal arm 54 at the illustrated location spaced apart from the pedal 56 via welding or some other attachment means or type. The guard plate 58 can include a pair of spaced apart embossments or raised portions 92,94 between which the pedal arm 54 is received, particularly middle portion 90 thereof. As shown, the embossments 92,94 can be angularly provided on the guard plate 58 for alignment with the middle portion 90 of the pedal arm 54. As best shown in FIG. 3, the guard plate 58 is longitudinally spaced (i.e., in a direction parallel to a direction of travel of the vehicle) from the pedal 56, and particularly the upper edge 56*b* of the pedal. The guard plate 58 has a contact surface 58*a* that, in the illustrated embodiment provides a vertical surface that is spaced apart from the pedal 58 for engaging a foot 96. With reference to FIG. 5, the guard plate 58 can be configured and mounted such that contact surface 58*a* is angled about 5° relative to the upper edge 56*b* of the pedal (or relative to a transversely extending axis of the vehicle). This arrangement facilitates the foot 96 first contacting the guard plate 58 and/or assists in stabilizing the foot 96 on the pedal 56 during a crash event.

Moreover, a lower edge or portion 58*b* of the guard plate 58 is positioned vertically below the upper edge or end 56*b* of the pedal 56. In addition, the guard plate 58 has a first lateral edge 58*c* that is generally aligned with the first lateral edge 56*c* of the pedal 56 and the guard plate 58 has a second lateral edge 58*d* that is generally aligned with the second lateral edge 56*d* of the pedal 56. This configuration has been found to provide stability to a driver's foot when positioned on pedal 56, and particularly when the driver's foot slides forward off the upper edge or end 56*b* of the pedal 56 during a crash event (e.g., foot 96 shown in phantom in FIG. 4). In such a crash event, foot 96 can contact the guard plate 58 which stabilizes the driver's lower leg to reduce the potential for injury to the driver during the crash event.

Figure 6:
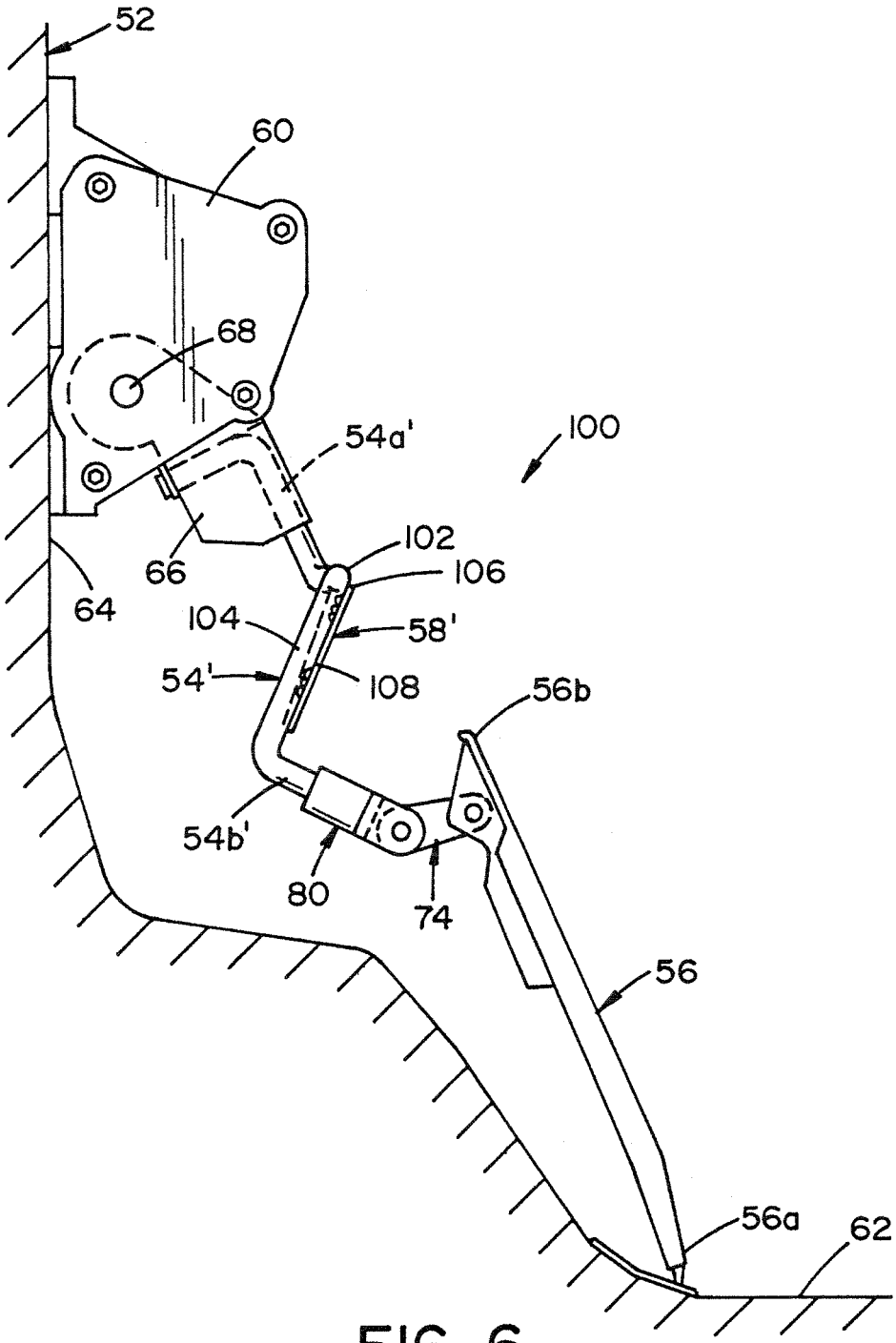
FIG. 6 is a schematic elevational view of an accelerator pedal assembly for a vehicle according to an alternate embodiment.
Figure 7:
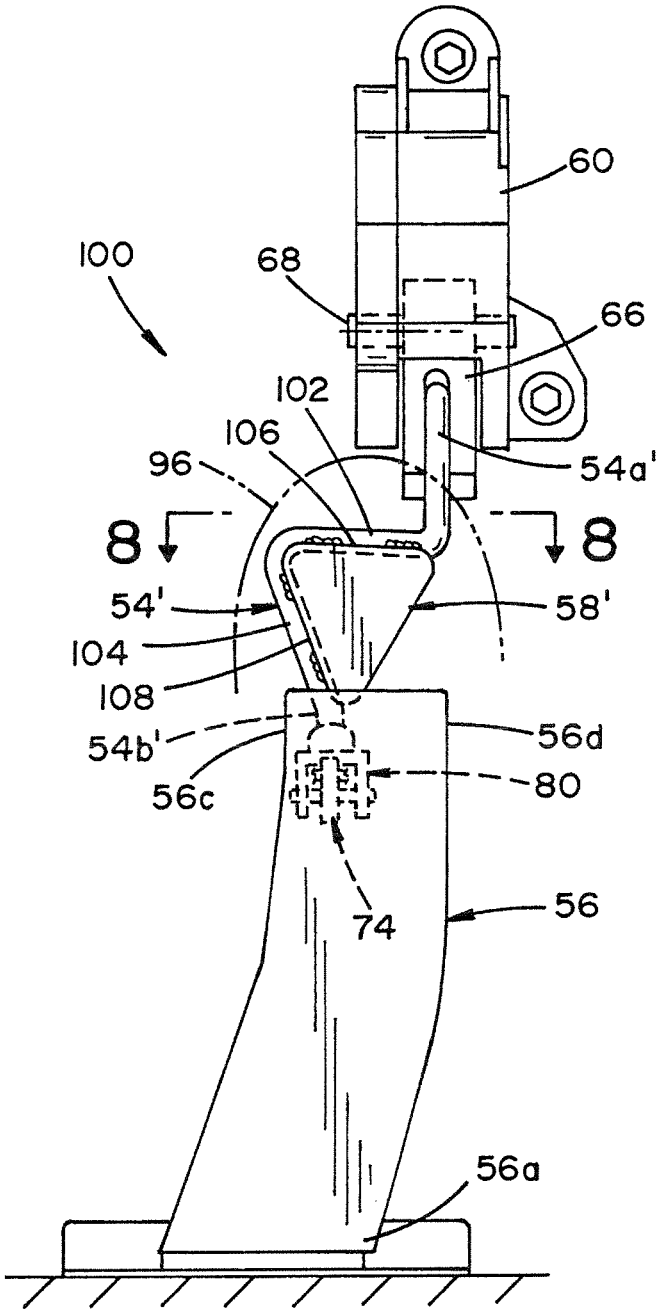
FIG. 7 is a front elevational view of the accelerator pedal assembly of FIG. 6.
Figure 8:
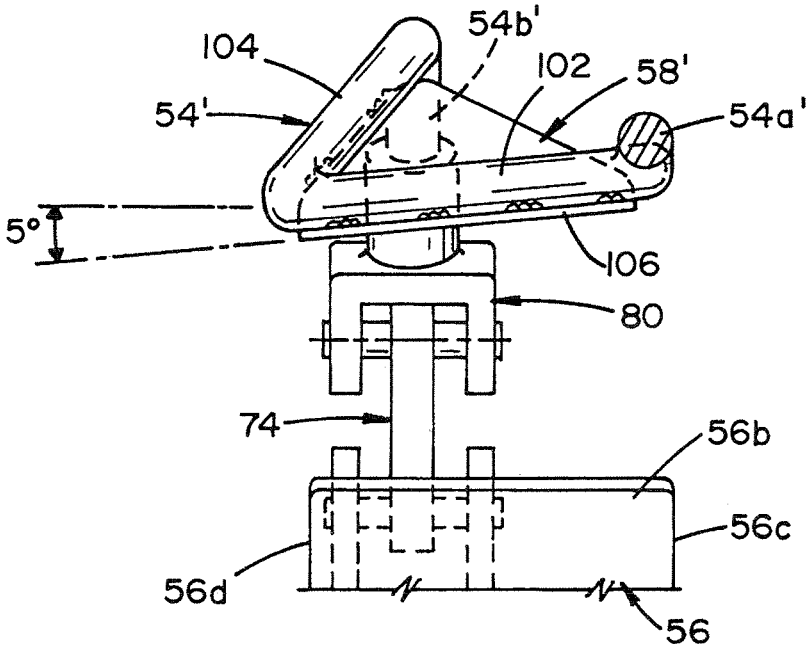
FIG. 8 is a partial cross-sectional view of the accelerator pedal assembly taken along the line 8-8 of FIG. 7.

With reference now to FIGS. 6-8, another exemplary embodiment of an accelerator pedal assembly for a vehicle is illustrated and generally indicated by reference numeral 100. Except as indicated herein, the pedal assembly 100 is the same as the pedal assembly 50 of FIGS. 3-6 and thus like reference numerals are used on like components (similar components are also identified with like reference numerals, but with a primed (') suffix, and new components are identified with new numerals). Like the accelerator pedal assembly 50, the pedal assembly 100 includes a pedal arm 54' extending from a pivot connection (i.e., movable member 66 pivotally connected to mounting support 60 via pivot pin 68). A guard plate 58' is mounted to the pedal arm 54'. Pedal 56 has its upper end 56*b* pivotally connected to the pedal arm 54' at a location spaced apart from the guard plate 58'. End portions 54*a'* and 54*b'* of the pedal arm 54' can be pivotally connected to the mounting support 60 and pedal 56, respectively, as described above in reference to the pedal assembly 50.

The pedal assembly 100 is different from the pedal assembly 50 in that its pedal arm 54' includes a two-segment middle portion comprising first segment 102 and second segment 104. In addition, the shape of the guard plate 58' and its mounting to the pedal arm 54' differs relative to the pedal assembly 50. In particular, the guard plate 58' has a triangular shape that includes a top side 106 welded to the first segment 102 and a first lateral side 108 welded to the second segment 104.

The pedal arm 54' includes a first end portion 54*a'* similar in configuration to first end portion 54*a* of pedal arm 54 (FIGS. 2-5). The first middle segment 102 extends transversely from a distal end of the first end portion 54*a'*, which is laterally aligned with the first lateral edge 56*c* of the pedal 56, toward lateral alignment with an opposite second lateral edge 56*d* of the pedal 56. The second middle segment 104 extends transversely from a distal end of the first middle segment 102 toward the upper edge 56*b* of the pedal 56. As already indicated, the guard plate 58' is fixedly secured to both middle segments 102,104. As best illustrated in FIG. 8, the first middle segment 102 extends transversely at about a 5° angle toward the pedal 56 as it extends laterally from the first end portion 54*a'* toward the second middle segment 104 and the second lateral edge 56*d* of the pedal 56 (i.e., about 5° relative to a transversely extending axis of the vehicle). This angular configuration facilitates foot 96 first contacting the guard plate 58' and/or assists in stabilizing the foot 96 on the pedal 56 during a crash event.

The exemplary embodiment(s) have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An accelerator pedal assembly for a vehicle, comprising:

a pedal arm having a first end portion pivotally secured to the vehicle;

a pedal having an upper end pivotally mounted to a second end portion of said pedal arm; and a guard plate secured to said pedal arm forwardly of said pedal, said guard plate having a top side, a first lateral side and a second lateral side, wherein a first lateral edge portion of said first lateral side adjacent said top side is aligned with a first lateral edge of the upper end of said pedal, and a second lateral edge portion of said second lateral side adjacent said top side is aligned with a second lateral edge of the upper end of said pedal;

wherein said pedal arm includes a first end portion extending from a mounting support, a middle portion having a first middle segment and a second middle segment extending transversely from said first middle segment, and a second end portion extending toward said pedal, wherein said guard plate includes a first edge secured to said first middle segment and a second edge secured to said second middle segment.

2. The pedal assembly of claim 1 further including:

a link connecting said pedal and said pedal arm, said link having a first end pivotally connected to said pedal arm and a second end pivotally connected to said pedal.

3. The pedal assembly of claim 1 wherein said first end portion extends from a pivot location at which said pedal arm is pivotally secured to the vehicle;

said middle portion extends downward from said first end portion; and said second end portion extends from said middle portion toward said pedal.

4. The pedal assembly of claim 3 further including:

a link having a first end pivotally connected to a distal end of said second end portion and a second end pivotally connected to said pedal.

5. The pedal assembly of claim 3 wherein said middle portion of pedal arm extends angularly from said first end portion downwardly and transversely across the vehicle.

6. The pedal assembly of claim 5 wherein a first end of said middle portion is laterally aligned with the adjacent first lateral edge of said pedal and a middle end of said second end portion is laterally aligned adjacent the second lateral edge of said pedal.

7. The pedal assembly of claim 1 wherein said mounting support pivotally connects said pedal arm to a body portion of the vehicle.

8. The pedal assembly of claim 1 wherein said first middle segment extends transversely from a distal end of said first end portion; and said second middle segment extends transversely from a distal end of said first middle segment toward the upper end of said pedal.

9. The pedal assembly of claim 8 wherein said guard plate is triangular shaped.

10. The pedal assembly of claim 1 wherein said guard plate is longitudinally spaced from said pedal.

11. The pedal assembly of claim 10 wherein a lower portion of said guard plate is positioned vertically below the upper end of said pedal.

12. The pedal assembly of claim 1 wherein said guard plate has a contact surface that extends in a vertical plane spaced apart from said pedal.

* * * * *